US007186061B2

(12) United States Patent
Foo et al.

(10) Patent No.: US 7,186,061 B2
(45) Date of Patent: Mar. 6, 2007

(54) SELF-REGULATING JACKING SYSTEM

(75) Inventors: Kok Seng Foo, Singapore (SG); Chuan Beng Tay, Singapore (SG)

(73) Assignee: Offshore Technology Development Pte Ltd., Sinapore (SG)

( * ) Notice: Subject to any disclaimer, the term of this patent is extended or adjusted under 35 U.S.C. 154(b) by 0 days.

(21) Appl. No.: 11/228,573

(22) Filed: Sep. 15, 2005

(65) Prior Publication Data

US 2006/0062637 A1 Mar. 23, 2006

(30) Foreign Application Priority Data

Sep. 15, 2004 (SG) ..... 200405083-7

(51) Int. Cl.
*E02B 17/08* (2006.01)

(52) U.S. Cl. ..... 405/198; 405/196

(58) Field of Classification Search ..... 405/195.1–200
See application file for complete search history.

(56) References Cited

U.S. PATENT DOCUMENTS 4,269,543 A * 5/1981 Goldman et al. ..... 405/198
4,657,438 A * 4/1987 Gillis ..... 405/198
4,885,698 A * 12/1989 Kawasaki ..... 405/198
5,975,805 A * 11/1999 Morvan et al. ..... 405/198

* cited by examiner

*Primary Examiner*—Frederick L. Lagman
(74) *Attorney, Agent, or Firm*—Squire, Sanders & Dempsey

(57) ABSTRACT

The invention relates to mobile offshore jack-up structures and provides for a self-regulating jacking system for elevating and lowering of the legs and the hull. A central controller assembly regulates movement of each of the legs, depending on the relative speed of movement of each leg and inclination of the hull along two independent axes: forward-aft and starboard-port. Each chord of the supporting legs is inverter driven to ensure a bi-directional full rated torque control of the associated pinion assemblies at very low speeds. By regulating the relative speed of the leg vertical movement, the system monitors the hull inclination within allowable limits and prevents an excessive differential vertical travel of any of the leg chords, thereby minimizing a possibility of leg bending or jamming of the screw jacks of the jacking assemblies 30.

14 Claims, 10 Drawing Sheets

SELF-REGULATING JACKING SYSTEM

SUMMARY OF THE INVENTION

It is an object of the present invention to provide a self-regulating jacking system for elevating and lowering of the legs and the hull, that minimizes leg deformation and damage to the hull structure and jacking machinery.

It is another object of the present invention to provide a self-regulating jacking system that can detect the extent of leg bending, differential chord loading and hull inclination during elevating and lowering of the hull.

It is a further object of the present invention to provide a provide a self-regulating jacking system that can gradually correct and maintain the extent of leg bending, differential chord loading and hull inclination within recommended operating limits.

These and other objects of the present invention are achieved through a provision of a control assembly that regulates relative movement of each of the chords of the supporting legs to prevent misalignment and bending of the legs during elevation and lowering procedures. Each supporting leg has a plurality of leg chords engaging pinion assemblies of the respective jacking assemblies 30. An inverter-driven motor causes vertical movement of each of the leg chords. The speed of movement of the leg chords is coordinated by a leg position controller, one for each leg, so as to maintain the rack phase differences of the leg chords within an acceptable range.

The leg position controller units transmit signals to a central position controller, which also receives a feedback signal from a hull inclination sensor. The hull inclination sensor detects hull inclination along two independent axes: forward-aft and starboard-port. By correlating the signal from the hull inclination sensor with the feedback from speed sensors associated with each of the supporting legs, the central control unit generates a control signal for regulating actual elevating speed of each leg, while continuously calculating the base speed references to be transmitted to each individual leg position controllers, which in turn calculate and transmit chord speed references to each of the motors operating the leg movement. By varying the relative speed of each leg, the control assembly regulates the hull inclination within the allowable levels and minimizes leg bending and deformation.

DETAIL DESCRIPTION OF THE PREFERRED EMBODIMENT

Reference will now be made to the following detailed description, taken in conjunction with the accompanying drawings, wherein like parts are designated by like numerals.

Referring now to FIGS. 1–5, FIG. 1 shows a self-elevating jack-up unit. The jack-up unit is a mobile offshore structure that is used for mineral exploration and production. A typical jack-up unit is provided with a plurality of truss legs 11, which extend through openings 14 in a floatable hull 16 of the jack-up unit. Although any number of legs may be used to support the hull 16, for illustration purposes, the jack-up unit shown in FIGS. 1 and 2 has three such legs 11.

Figure 2:
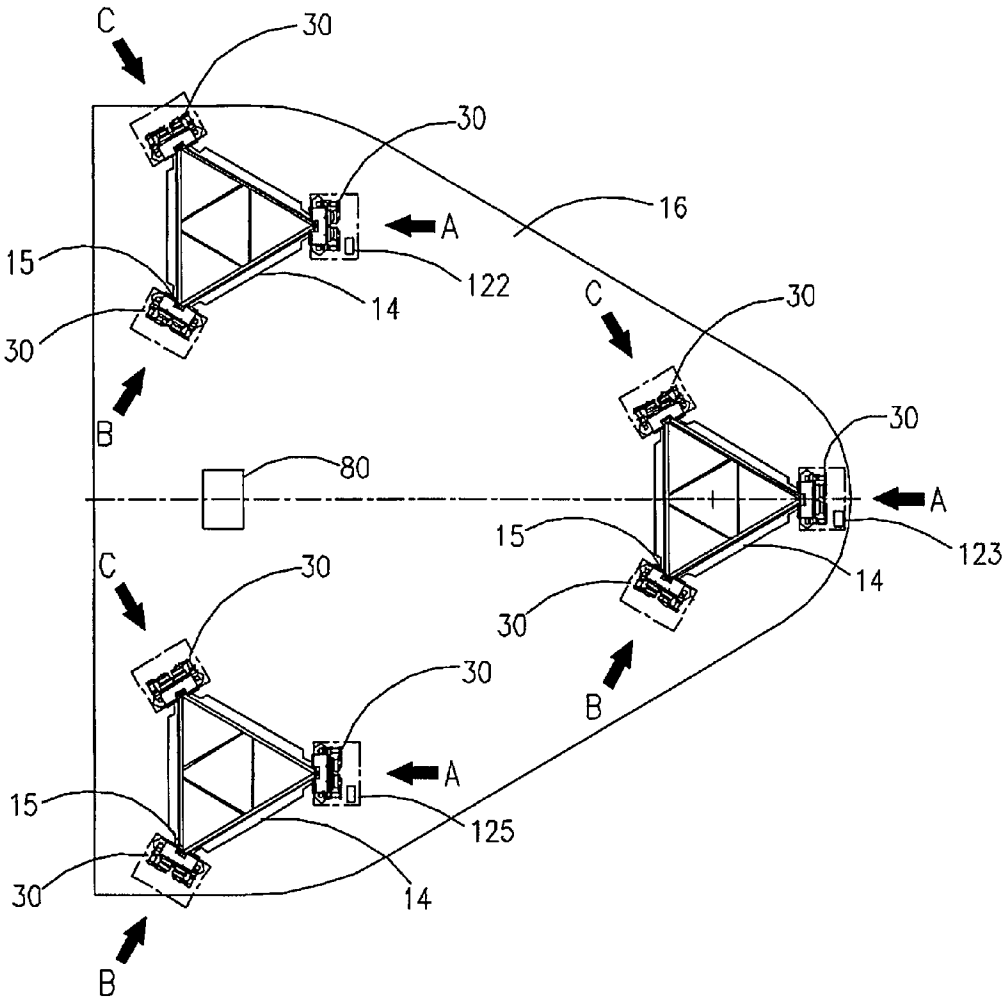
FIG. 2 is a plan view of a platform of the jack-up unit showing pinion gear drives for moving the truss legs.

As shown in more detail in FIG. 2, a typical leg of a jack-up unit has three mutually parallel chord members 15, and each chord member 15 is provided with a pair of opposing rack members that extend longitudinally along the length of the chords 15. The outward surfaces of the racks are provided with rack teeth 17 (FIGS. 11–13), which engage respective teeth 19 of rack chocks 32 and the pinions 34 carried by elevating jack units 30.

Conventionally, there is one jacking assembly 30 for each chord member 15. Horizontal and inclined braces or trusses 23 rigidly interconnect the chords 15. The chords 15 are located at apexes of the triangularly shaped legs 11, as can be better seen in FIG. 2. Of course, the number of chords and the shape of the legs are not limited to the embodiment shown in the drawings.

Figure 1:
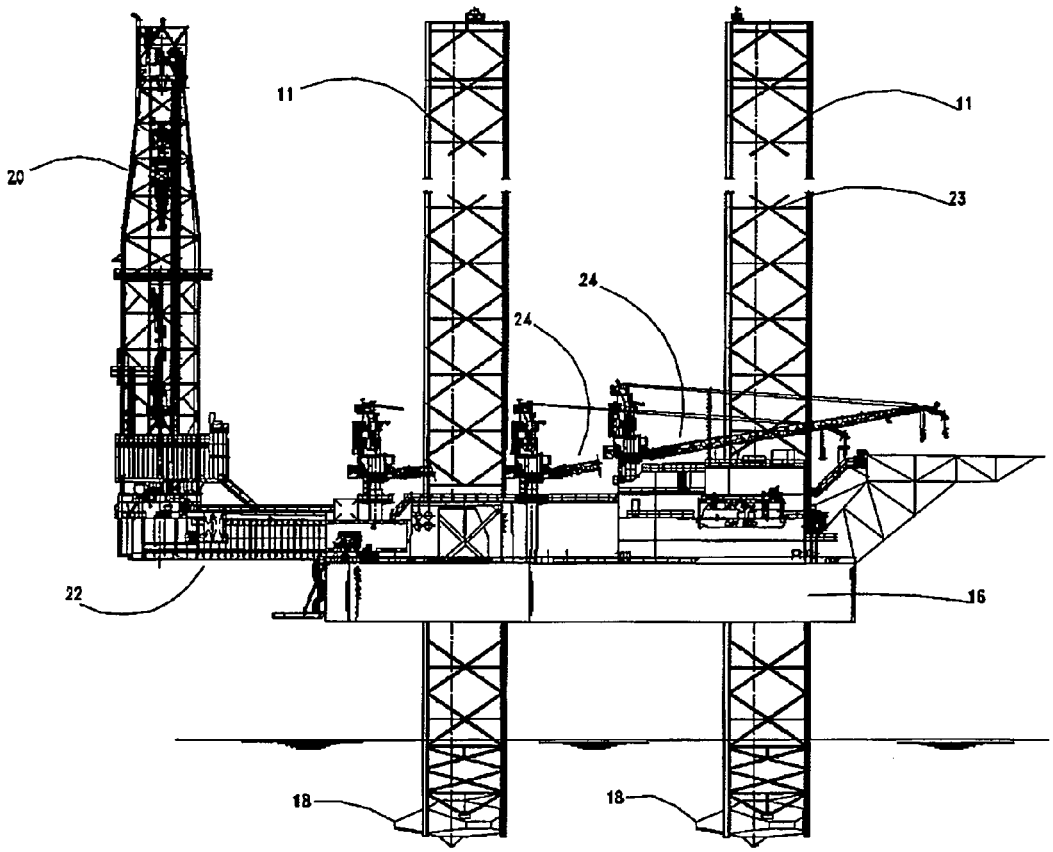
FIG. 1 is a schematic view of a jack-up unit with truss legs.

Each leg 11 is provided with the jacking assemblies 30 for moving the leg vertically with respect to the hull 16. The legs 11 move from a raised position, when the jack-up unit is in transit and the legs 11 are supported by the hull 16, to a lowered position, when the legs 11 support the hull 16. The lowered position is illustrated in FIG. 1. Each leg 11 may be provided with a spud can 18 for bearing against an ocean floor and for supporting the jack-up unit.

As the legs 11 are "jacked," the hull 16 is elevated above an anticipated wave action to support the offshore exploration and/or production operations. Conventional offshore platforms, such as the jack-up unit, are equipped with a derrick 20 mounted on the hull 16. The derrick may be also mounted on a cantilever structure 22, which extends outwardly from the hull 16, as shown in FIG. 1.

The derrick may be positioned for a limited lateral movement to accommodate well drilling in a plurality of locations without changing the position of the legs 11. The jack-up unit may be also provided with auxiliary equipment, such as cranes 24, pipe racks, heliport, crew living quarters, etc.

Figure 7:
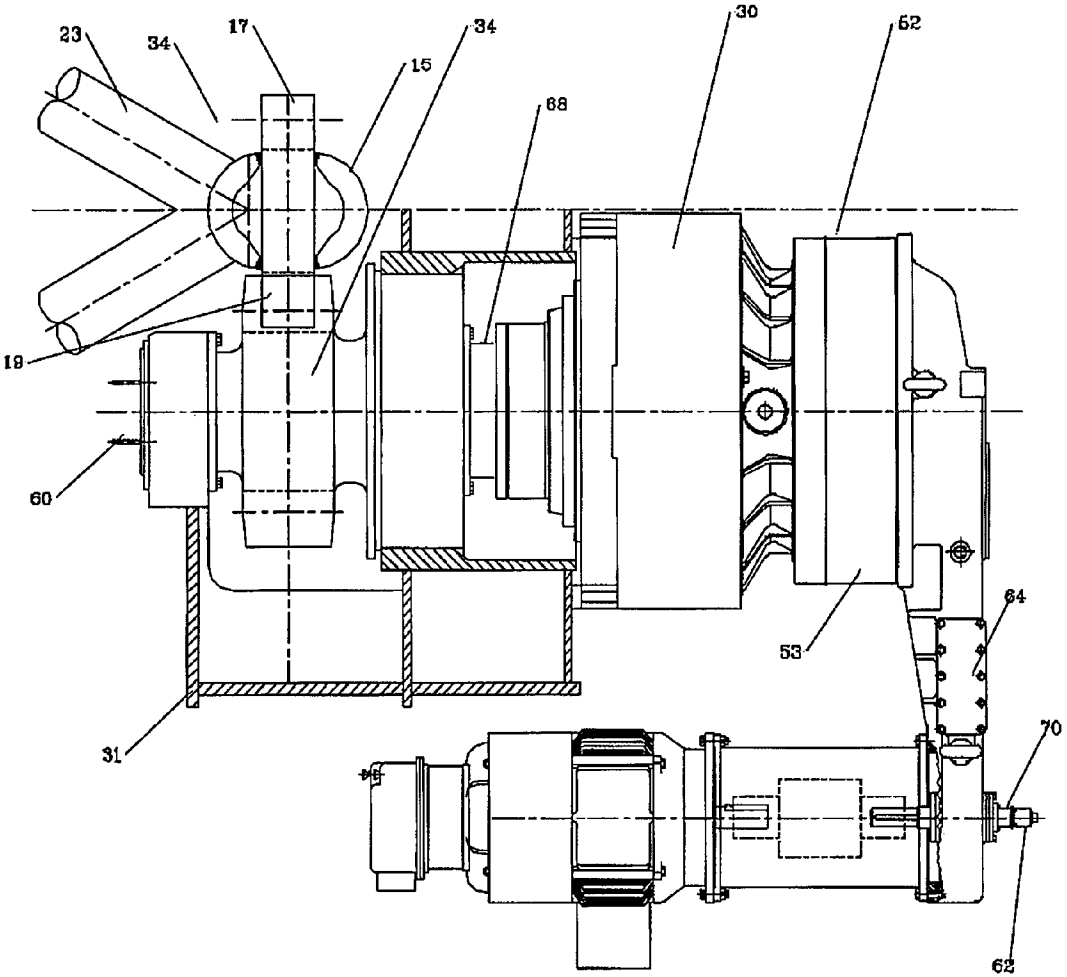
FIG. 7 is a detail view showing an electrically driven elevating gear assembly and a speed and position feedback device.

The jacking assemblies 30 are retained against vertical displacement by the hull 16. As shown in FIGS. 2–5, a typical rig has nine jacking assemblies 30; three assemblies per leg, with one located at each leg chord 15 of the triangularly shaped legs 11. Each elevating jacking assembly 30 is secured to the hull within a jack housing 31. Each elevating jacking assembly 30 is provided with four pinions 34, which operationally engage teeth of racks 17, 19 associated with the legs 11 (FIG. 7). The rack and pinion assemblies are designed to allow a very close tolerance between teeth engaging surfaces of the racks and pinions. These surfaces are designed to mate for better load transfer and stable support of the platform. Since a possibility of misalignment between pinions engaging opposing racks is always present, jamming condition may be encountered during start-up and running of the motor, i.e. when the legs are being moved vertically.

Gear assemblies 52 assist vertical movement of the legs. A gear assembly 52 of the present invention is shown in more detail in FIG. 7. The gear assemblies are similar for all rack and pinion jacking assemblies 30 employed in the present invention and only one such assembly is illustrated in detail and described herein.

Each electrically driven elevating gear assembly 52 comprises a gear wheel 53, which is mounted on an elongated rotating shaft 60. A power source is coupled at the input end of the gearbox. A power source causes rotation of the pinions 32, moving the legs up or down in relation to the hull 16, while the jacking assemblies 30 remain stationary in relation to the hull.

The shaft 60 extends though a center of the gear wheel 53. An encoder 62 is operationally connected to the shaft 60 though a set of gear trains 64. As shown in FIG. 7, the encoder 62 is mounted on a side opposite an input end 68 of the gear assembly 50. A shaft 70 of the encoder 62 is coupled to the first stage of the gear assembly 52, which is directly coupled to the gear input shaft 60. The encoder 62 measures the rotational speed of the input shaft 68 of the gear assembly 52 during operation of the rack and pinion jacking assembly 30 and converts mechanical motion of the input shaft into electrical signals containing information about the rotational speed as well the direction.

Figure 6:
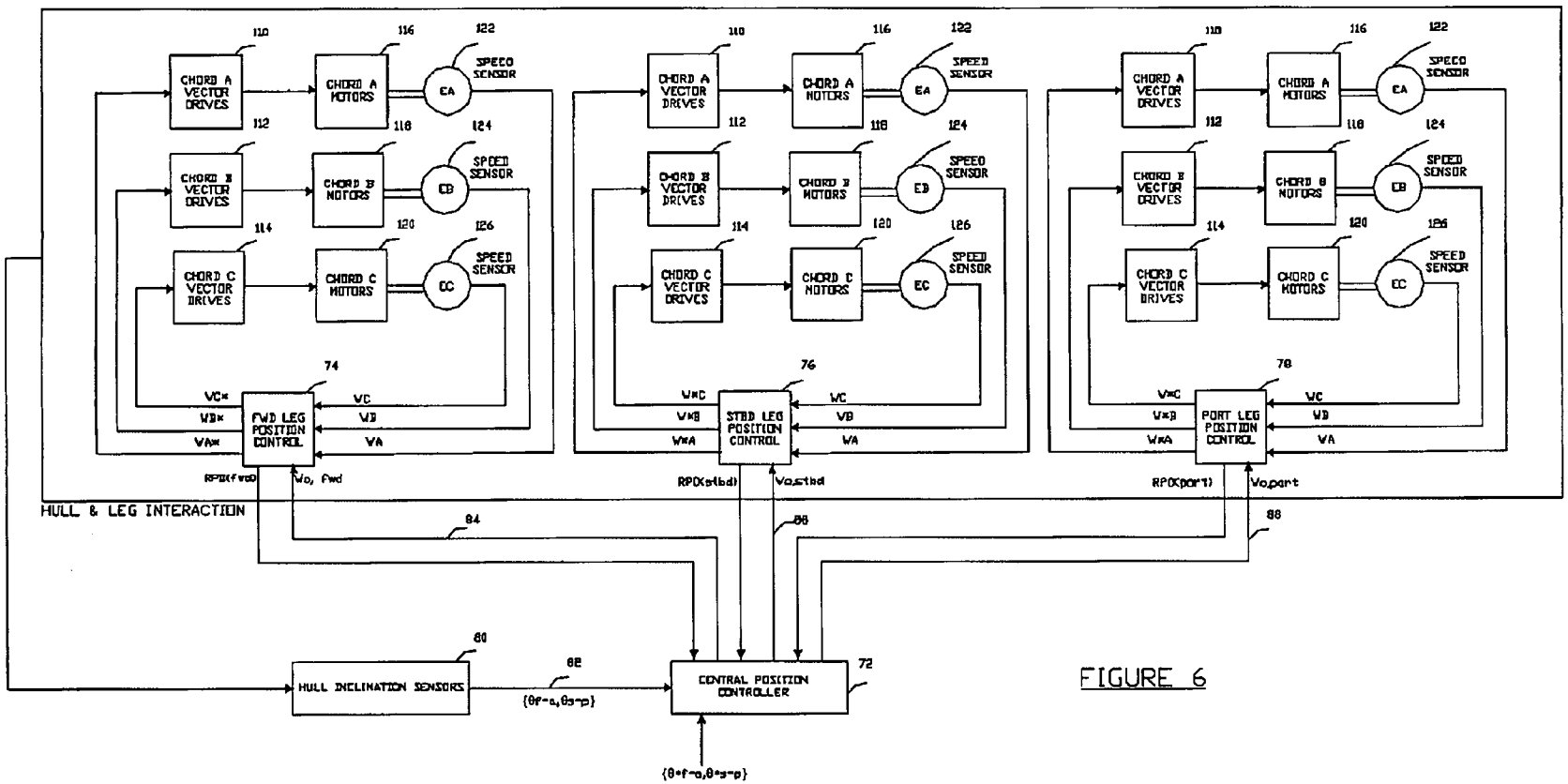
FIG. 6 is a block diagram of the control system in use in the self-regulating jacking system of the present invention.

Although the speed feedback device in FIG. 7 is an encoder coupled to the input end of the gearbox in FIG. 6, several other possible installations exists. For example, the device can be a tachometer or encoder installed at the brake-end of the motor, a resolver inside the motor or an induction-based sensor clamped around the main motor shaft.

The present invention is designed to minimize leg deformation and damage to the hull structure and jacking machinery by detecting the extent of leg bending, differential chord loading and hull inclination. The system of the instant invention gradually corrects and maintains the extent of leg bending, differential chord loading and hull inclination within recommended operating limits. The ability to detect, correct and control the extent of leg bending is critical to an optimized design of the leg structure. If leg bending can be limited, thickness of leg braces and tolerances of leg guides can be reduced, leading to an improved overall rig performance at a lower structural cost. Furthermore, the invention offers enhanced protection not only to the structure, but also to the motors, brakes and gear trains.

FIG. 6 shows a control block diagram of the self-regulating jack-up elevating system of the instant invention. A central control unit (central position controller) 72 is operationally connected to three leg control units 74, 76 and 78. The leg position control units 74, 76, and 78 are each provided with a feedback devices, one for each chord, such as accelerometers 122, 124, and 126 located on top of jack housing, or jack cases of the jacking assemblies 30, closely following and controlling the speed of movement of the leg chords. The sensors for the port leg are designated by combined numeral 122, accelerometers for the forward leg chords are designated by numeral 123, and accelerometers for the starboard leg are designated by numeral 125. The local control unit 74 controls the operation of the forward leg, the control unit 76 controls the operation of the starboard leg, and the control unit 78 controls the operation of the port leg.

The system has two control loops: a central control loop and a leg local control loop. The first control loop (central control loop) primarily controls the hull inclination. The central controller receives feedback from one or more orthogonal dual-axis inclination sensors 80, which are located in the hull 16. The sensors 80 provide electrical signals that are proportional to the hull level in the two independent axes $\theta_{F\text{-}A}/\theta_{S\text{-}P}$ illustrated as arrow 82 in FIG. 6. Using this information with the actual elevating speed of each leg, the central controller 72 calculates new base speed reference 84, 86, and 88 to be transmitted to each leg, individually. By varying the relative speed of each leg, the central controller 72 regulates the hull inclination within the allowable inclination limits.

The second control loop is a local chord speed control. The local controller receives the base speed reference 84, 86, and 88 from the central controller and varies the speed of the leg chords within a speed range. The primary objective is to ensure that the Rack Phase Difference values are within the allowable limits. As can be seen in FIG. 6, the signal from the leg control unit 74 is transmitted to three inverters 110, 112, and 114, designated as "Chord A vector drives," "Chord B vector drives," and "Chord C vector drives," respectively.

The signal from each of the inverters 110, 112 and 114 is transmitted to the associated motors 116, 118, and 120 for the particular chord A, B, and C. As a result, each of the chord motors is individually inverter-driven. Feedback is obtained from speed and position sensors 122, 124, and 126 located at each chord A, B, and C of the leg. The data gathered by the sensors 122, 124, and 126 is forwarded to the leg position control 74 to allow continuous monitoring of the leg elevation or lowering speed.

The same system of leg chord control is used for the starboard leg position control 76 and the port leg position control 78.

Figures 3, 4, 5:
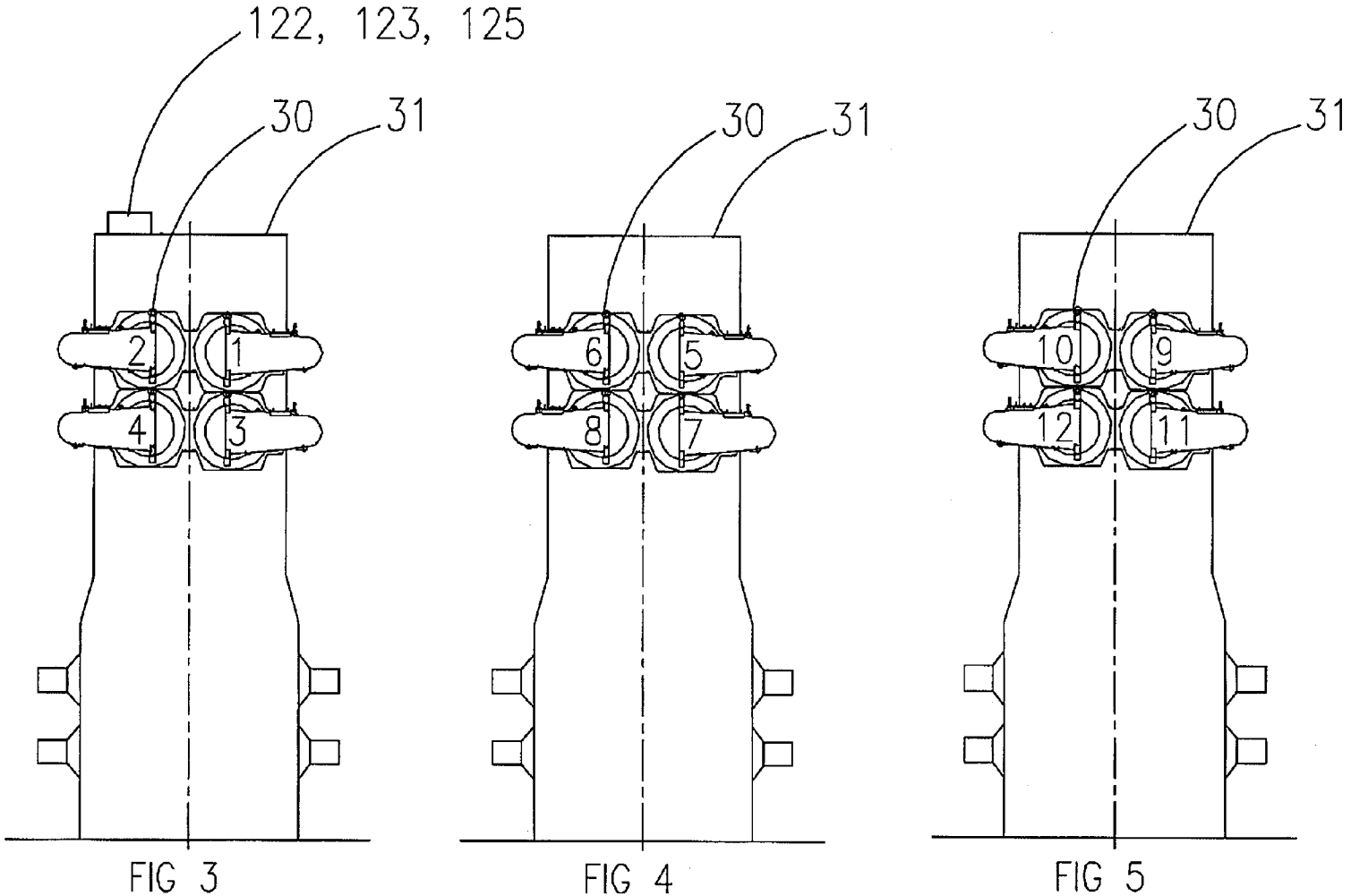
FIG. 3 is a detail view of a gear assembly shown in FIG. 2 taken in the direction of arrows A in FIG. 2.
FIG. 4 is a detail side view of a gear assembly shown in FIG. 2 taken in the direction of arrows B in FIG. 2.
FIG. 5 is a detail side view of a gear assembly shown in FIG. 2 taken in the direction of arrows C in FIG. 2.
Figure 8:
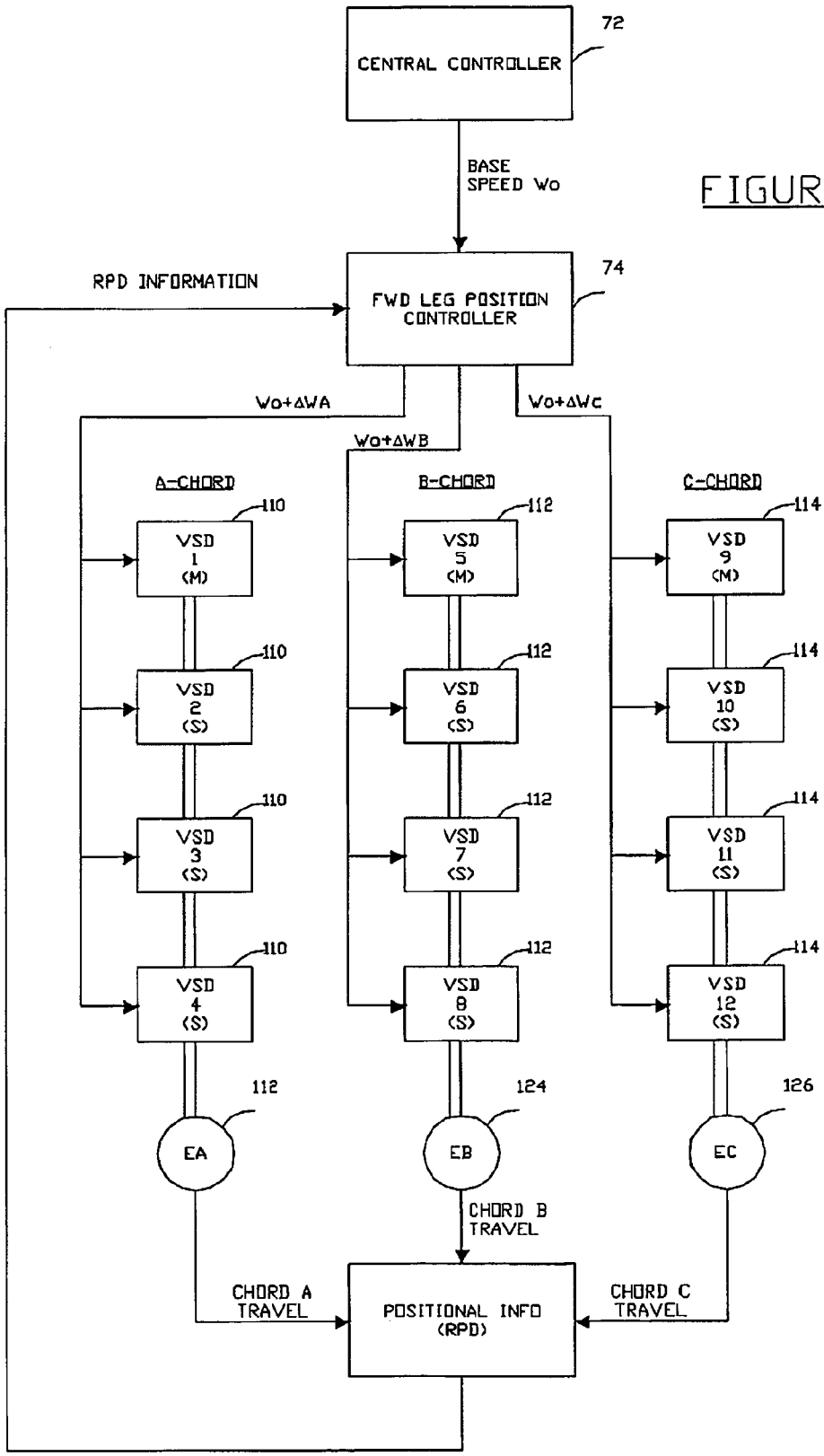
FIG. 8 is a block diagram of a local leg control assembly.

FIG. 8 illustrates in more detail the local leg control diagram in association with the forward leg position controller 74. It will be understood that the starboard and port leg controllers 76 and 78 have similar elements. As can be seen in the drawings, the motors 1 to 4 are operationally connected to rack chord A and grouped as Group A. Similarly, motors 5 to 8, shown in FIG. 4, are connected to rack chord B and grouped as Group B. The motors 9–12 of the rack chord C, shown in FIG. 5, are grouped as Group C in FIG. 8.

Each motor 1–4 of the A-chord group has an associated inverter 110 (VSD 1, VSD2, VSD3 and VSD4). Each motor of the B chord group has an associated inverter 112 (VSD5, VSD6, VSD7, and VSD8), and each motor of the C chord group has an associated inverter 114 (VSD9, VSD10, VSD11, and VSD12) in FIG. 8. The data on the travel of chord A, chord B and chord C is transmitted to the associated sensor, or accelerometer 122, 124, 126 and then as a positional information, or rack phase difference (RPD)—to the position controller 74.

As a result, the jacking motors are driven by vector-controlled drives. This arrangement offers many advantages over traditional DOL or scalar control methods, such as good dynamic performance at all speeds, full torque operation down to standstill to limit the peak loads that the motor transmits to the gear trains, and subsequently the pinions and rack, and the ability to operate the motor at many times the base speed for field-weakening applications. Each motor drive receives a speed feedback from the motor to form a high-performance closed-loop vector control.

In each of the motor groups, one of the drives functions as the chord master drive while the remaining three motors function as slaves. By default, the first motor in each group functions as the chord master drive. However, under various circumstances, the choice of chord master can automatically be changed to another drive. This switchover can be performed prior to an operation, or during the operation. A switchover during an operation is generally known as a "hot-switchover" and is usually accomplished within tenths of milliseconds, allowing a smooth transition, which is transparent to the users.

The leg position controller constantly acquires the following data:

chord travel distance from each chord master drives; and load from each pinion to eale-ulated calculate the chord loads and chord load differences.

The leg position controller performs the following functions:

calculates Rack Phase Difference (RPD) values from Chord A, Band C travel distances;

processes RPD, Chord Load and Chord Load Differences Values to determine individual chord speeds, within the allowable range of the base speed reference from the central position controller;

transmits speed references to individual chord master drives; and determines the assignment of drives as master or slave.

The individual chord master drives provide the corresponding chord travel to the leg position controller. In return, the leg position controller provides a speed reference signal to the individual chord masters, which will in turn, be transmitted to the slave drives. This will enable all the motors in the group or chord to run at the same speed. Each drive will keep track of the Chord Travel. This value is periodically checked and updated against the Chord Travel value inside the master drive, to ensure a consistent Chord Travel value upon changing of the master drive.

A bending moment on the leg can arise from various reasons, such as incorrect positioning of the leg on the seabed, uneven seabed, presence of horizontal loads due to currents and wind, as well as different chord loads leading to different chord elevation speed. The leg guides take up most of the leg bending moments. Large horizontal forces between the legs and the guides will lead to leg bending and deformation, which can be measured by the Rack Phase Differences (RPD). A method of measuring RPD is given in U.S. Pat. No. 5,975,805 issued to Morvan et al. on Feb. 6, 1998. Another way to measure leg deformation is through the chord load differences (CLD).

In the instant invention, at the central controller 72, speed regulation is performed between the legs to keep the hull 16 level. A dual-axis inclination sensor 80 provides the central controller 72 with the current data on the hull level. Using this information, the central controller 72 provides the base speed reference to the individual leg controllers 74, 76, and 78. The base speed reference will vary with the magnitude of out-of-level reference data. As the out-of-level condition decreases, the difference in base speed will reduce. This will help to prevent oscillations. Once the hull level is within the allowable limits, the base speed for all three legs will be the same to maintain the level.

At the local leg controllers 74, 76, and 78, this base speed reference will be used to regulate the chord speeds. The chord speed is allowed to vary within a range from the base speed reference so that RPD corrections can be performed locally.

For example, and not by way of limitation, if the starboard-port inclination is level and the forward-aft inclination is 1.0 degrees, then the base speed for the forward leg will be 59 Hz (1180 rpm) while starboard and port leg will be 57 Hz (1140 rpm). The motors located at the forward leg are allowed to adjust their speed within the range of 59±1 Hz (1160 to 1200 rpm) to adjust their RPD and CLD values. Similarly, the starboard and port leg motors can vary in the range of 57±1 Hz (1140 to 1160 rpm). The net effect will be the forward part of the hull 16 will be elevated at a faster average speed than the starboard and port, in order to correct the hull level.

Figure 9:
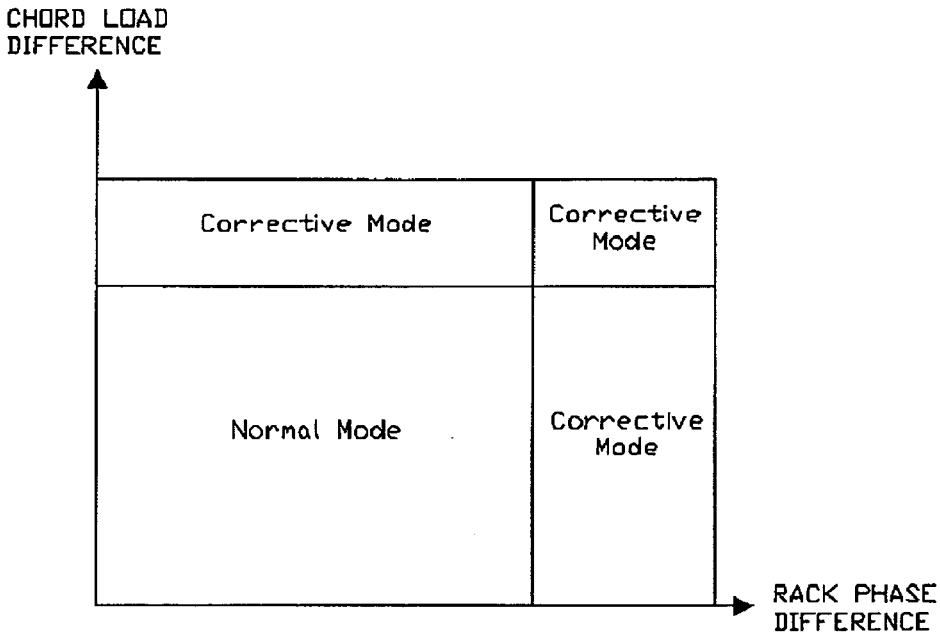
FIG. 9 is a schematic illustration of the mode of operation of a local controller assembly.

There are two distinct modes of operation at the local controllers as shown in FIG. 9. Self-regulating operation will stop once the operating point falls outside any of the four regions. System will revert to manual mode for correction by the barge engineer or rig mover. Below is a description of the two modes of operation.

1. Normal Mode: Both the RPD and CLD values are less than the lower threshold. The system will elevate the hull in a uniform manner, in order to maintain the RPD values constant.
2. Corrective Mode: RPD and/or CLD values exceed the threshold. If the operation is hull up, the system will adjust chord speed of the chord with the highest RPD value by slowing down the leg elevation speed. If the operation is hull down, the system will adjust by slowing down the chord that is the lowest, i.e. lowest RPD value.Chord elevation speed variation is performed within a small range, i.e. base frequency±1 Hz, corresponding to a±1.7% slip of the motors. The chord elevation speed range is small to allow gradual and controlled correction of the RPD values. Once the highest RPD value is brought down to the allowable lower threshold, the system will revert to normal mode, and elevate all chords at the same speed to maintain the present set of RPD values.

For hulls that demonstrate significant hull sagging or hogging, additional measures have to be implemented to prevent over-correction when hull is lifted out of water. When the hull is in the water, buoyancy will lift the center of the hull higher while the legs will pull the edges of the hull down, causing the hull to hog. As the hull comes out of the water, the center of the hull becomes heavier due to reduced buoyancy forces. As a result the center of the hull is lower than the edges of the legs, causing the hull to sag. Correction is performed by comparing the tilt readings from accelerometers 122, 123, 125 or inclination sensors at the top of each jack case to detect the inclination of the jackcase relative to the center of the hull. By using the tilt angle of the jackcase and center of the hull, the RPD readings can be compensated according for hull hogging and sagging to prevent over-correction.

Figure 10:
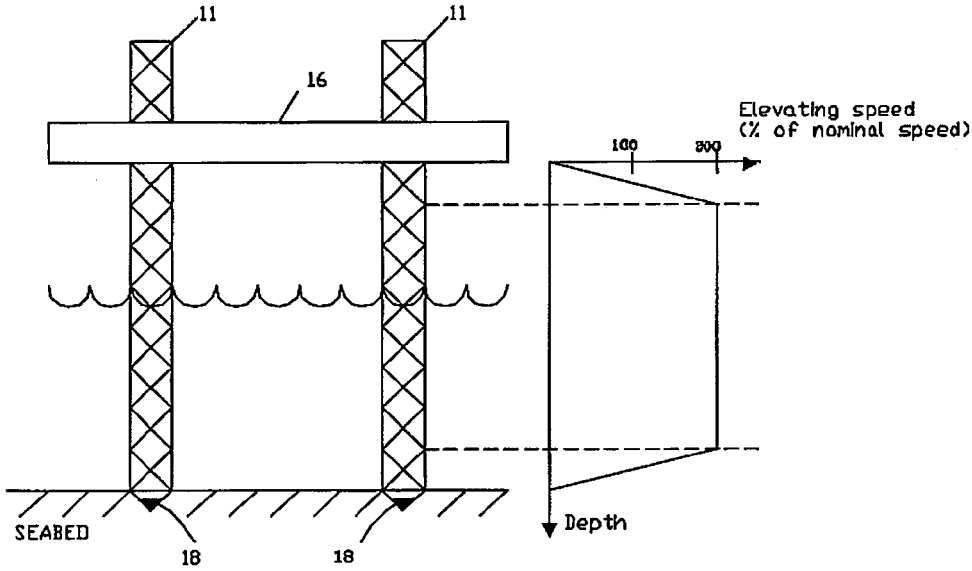
FIG. 10 schematically illustrates speed profile during a leg lifting or lowering operation.

FIG. 10 shows a typical speed profile during a leg lifting or lowering operation. This system optimizes the time required to lower the leg to the seabed or to raise the legs into a tow position. It allows the legs to be lifted or lowered at two to three times the base speed. During leg operations, the jacks 30 see a very much lower load compared to the rated load. As such, the motors are able to operate at the field weakening range.

At the same time, the system automatically monitors the leg travel and slows the speed down when the spud cans 18 approach the seabed or the hull 16. A slow approach speed of the spud can to seabed is important to reduce the contact impact on the structure and machinery. Similarly, an automatic stop when the spud can approaches the hull is important to prevent the spud can 18 from damaging the bottom of the leg well.

Figure 11:
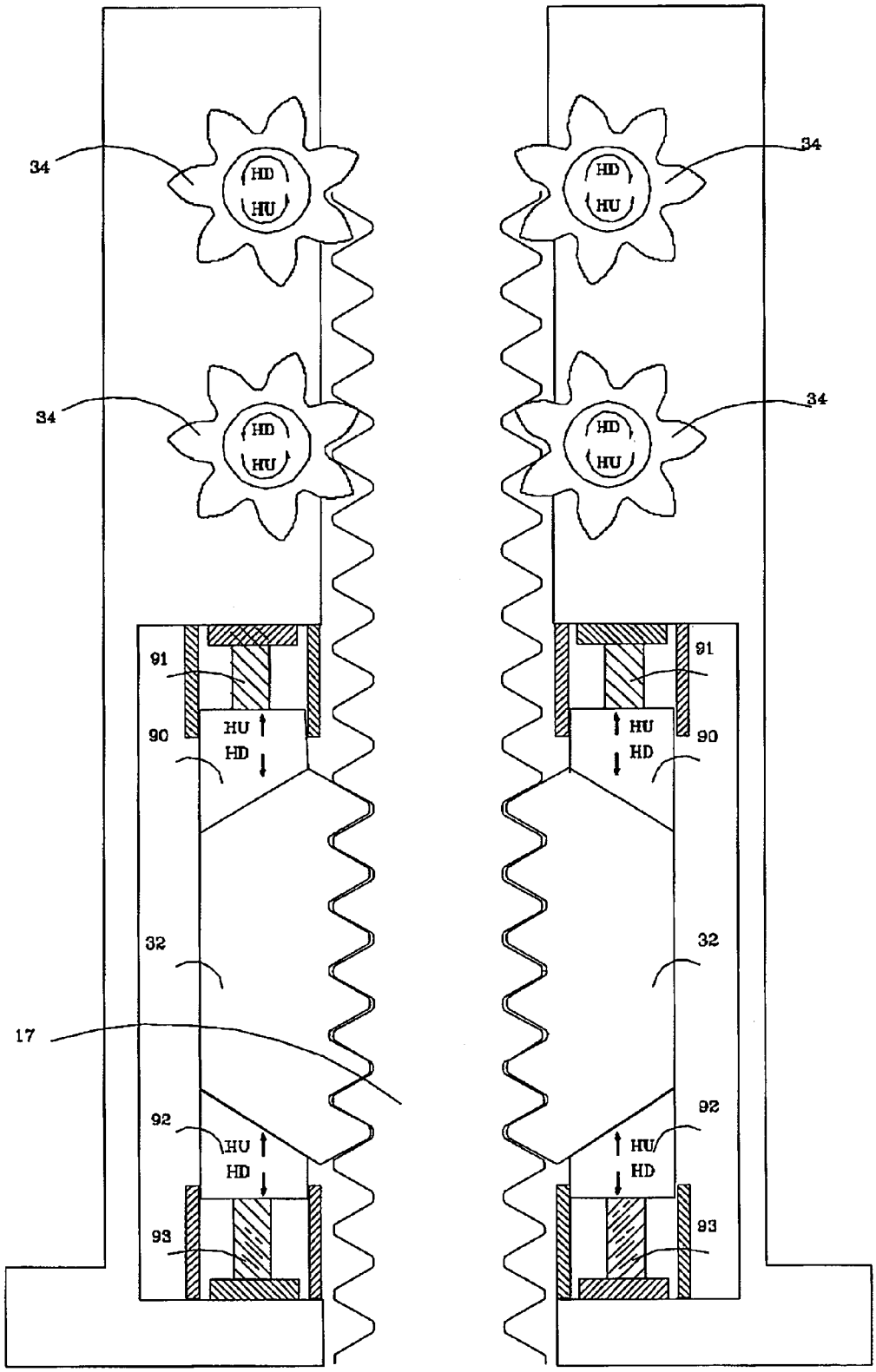
FIG. 11 is detail schematic view illustrating relative movement of a rack chock during hull up and down operation.

FIG. 11 shows the relative movement of a rack chock 32 during hull up and hull down operation. The top and bottom clamps 90, 92, respectively, are shown engaging opposite ends of the rack chock 32. The top clamp is engaged with a screw jack 91, while the bottom clamp 92 is engaged with the bottom screw jack 93.

Figure 13:
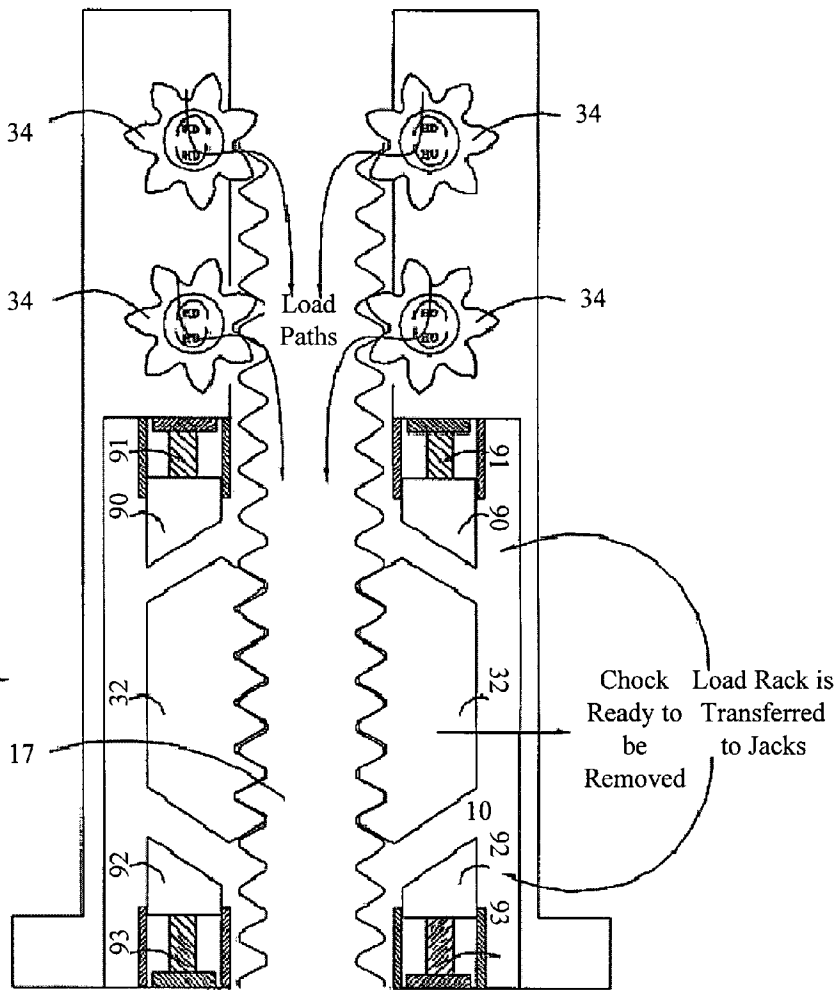
FIG. 13 is a detail schematic view illustrating relative position of a leg rack, rack chock, and the top and bottom clamps with the chock ready to be removed.
Figure 12:
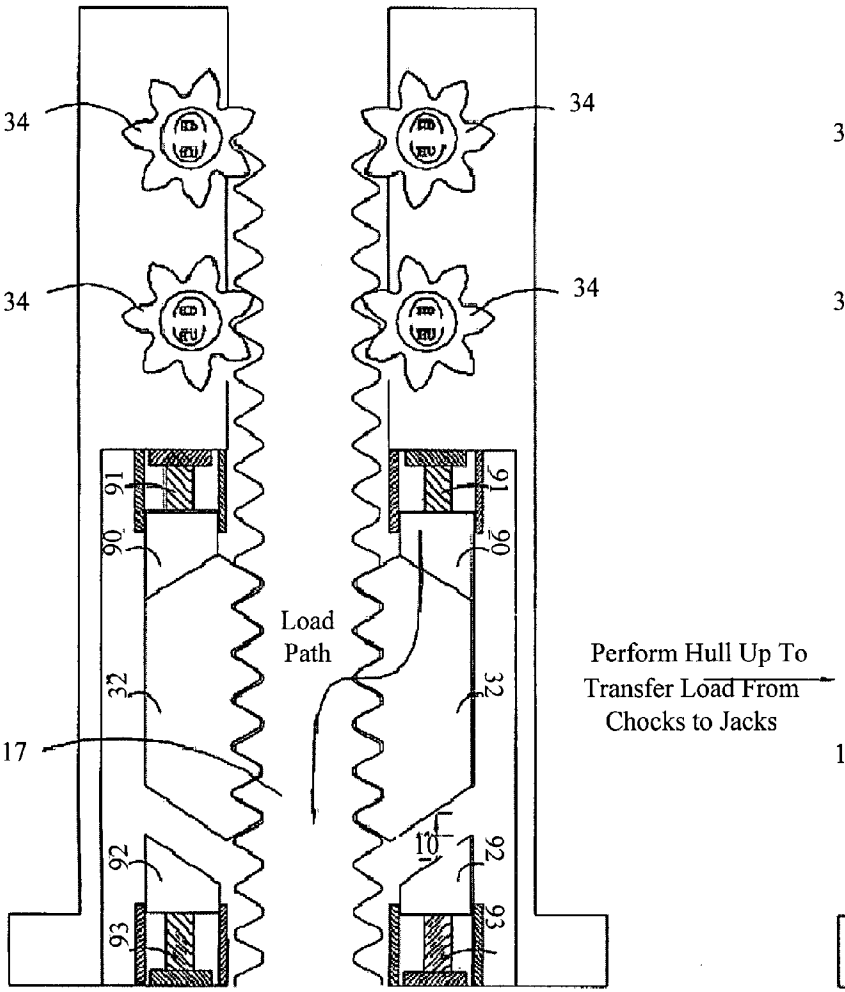
FIG. 12 is a detail schematic view illustrating relative position of a leg rack, rack chock, and the top and bottom clamps prior to a load transfer from the rack chocks to the jacks.

FIG. 12 shows the relative position of the leg rack 17, the rack chock 32, the top clamp 90 and bottom clamp 92 prior to a load transfer from the rack chocks to the jacks. In FIG. 12, the bottom clamp 92 has been opened up slightly, giving a gap of 2 to 5 cm between the chock and the bottom clamp 92. The usual procedure for load transfer will require a jacking operation to lift the hull 16 up slightly to create a small gap between the chock 32 and the top clamp 92, thus transferring the weight of the hull from the jacks. Once the weight has been successfully transferred, the clamps 90, 92 can be removed fully, and the chock 32 can be withdrawn, as shown in FIG. 13.

However, over a prolonged period of engagement, the mating surfaces may bind and thus lead to difficulty in removing the clamps 90, 92 from the chock 32, as well as the chock 32 from the leg rack 17. The usual method of freeing the clamps and chock is to jog the assembly 30 by performing a hull up and down using the jacks. As the jacks are usually single or dual speed, the jacks need to be restarted several times in opposite directions to produce the jogging effect. The operator also has to ensure that the jacks do not move too much in either direction to avoid jamming the screw jacks 91, 93 that are connected to the top and bottom clamps 90, 02, respectively. Further, the operator has to ensure that the electrical motors are not overheated due to the repeated starting process, or a prolonged locked-rotor condition. The repeated starting stresses also reduce the life of the electrical motors, gear trains, pinions and rack. Obviously, the process of freeing the clamps 90, 92 and chocks 32 may at times, be difficult and time-consuming.

The instant invention overcomes this difficulty by providing a means of bi-directional full rated torque control at very low speeds through the use of an inverter, allowing the jacking system to "wriggle" the rack chock free from the legs and screw jacks.

In an embodiment of the invention, the speed of the motor is limited to 10% of the nominal speed, in either direction. Full torque up to 150% of the rated torque is available over the entire speed range. The allowable limit for vertical displacement can be preset. The system will automatically jog the rack chock assembly within these limits by oscillating slowly between hull up and hull down. As the torque, speed and displacement of the motion is controlled, the possibility ofjamming the screw jacks 91, 93 is significantly reduced.

The present invention provides advantages not available with prior systems; it requires a single start for the entire operation, thus eliminating the associated electrical, mechanical and structural stresses. The instant invention also allows automatic control of the elevation distance to prevent excessive vertical travel, and in the process, jamming of the top or bottom screw jacks. This allows substantial savings in operation time and cost.

In addition to the above, other secondary benefits and improvements are realized such as:

1. Life enhancement of machinery consisting of the pinion, gear trains, motor and brakes.

Since all motors are inverter-driven, the speed of each motor can be gradually accelerated upon start, while providing full torque to hold and lift the hull slowly.

This allows the brake to fully release before the motor reaches its nominal speed. Similarly, the motor is able to coast down to a stop before engaging the brake to hold the pinion load, as compared to the traditional systems where power cut-off and brake engagement occurs simultaneously and the brake functions to stop the motor from nominal speed. These features enhance the life of the brake motors as it eliminates excessive wear due to brake drive-through.

Traditional systems use a direct-on-line (DOL) starting method, where electrical power is supplied directly to the motor from generator. The traditional system exposes the gear trains to very high peak loads during starting. These peak loads are usually 2 to 3 times higher than the nominal load during operation. Due to a variety of reasons, the load distribution for the pinions connected to a chord do not normally see equal loads, with some pinions seeing significantly higher loads than others. These occasional high loads reduce the life of the gear trains significantly. The instant invention overcomes this by using the inverter to limit the starting and running torque from the motor. In addition, this invention provides a means to create a master-slave relationship between pinions of the same rack in order to average the load distributions among the pinions.

2. Faster leg lowering to seabed, and vice versa.

The leg lowering process to the seabed during the transition from afloat to elevated position usually takes a significant amount of time. Some designs of jacking system utilize dual-speed motors to perform this operation. As the pinions see mainly the weight of the leg during leg lowering, the pinion loads are very much less than hull weight, thus allowing the motors to run at a much faster speed. Some jack-ups allow the legs to be lifted or lowered twice faster than the normal operation. The disadvantage of using a dual-speed motor is that it is usually much larger, heavier and costlier than the normal motor as it has two separate windings, leading to a costlier jack-up and a reduction in the jack-up and a reduction in the variable deck load.

This invention eliminates the need to have dual-speed motors by employing the inverter to operate the motors in the constant power region. In the constant power region, the reduced load conditions allows the motor to run at much faster speeds, ranging from two to three times the nominal speed. This will cut down the leg lowering or lifting time to half or one-third when compared to the single speed jacking system. This invention offers an additional advantage of automatic speed control over the dual-speed jacking systems.

3. A more effective load transfer mechanism from rack chocks to jacks.

The invention overcomes this difficulty by providing a means of bi-directional full rated torque control at very low speeds through the use of an inverter, providing an easier means to disengage the rack chock. Only requiring a single start for the entire operation, the system of the instant invention eliminates the associated electrical, mechanical and structural stresses. The invention further allows automatic control of the elevation distance to prevent excessive vertical travel, and in the process, jamming of the top or bottom screw jacks. This allows substantial savings in operation time and cost.

Many changes and modifications may be made in the design of the present invention without the spirit thereof. We, therefore, pray that our rights to the present invention be limited only by the scope of the appended claims.

We claim:

1. An apparatus for regulating movement of a jacking system of a mobile offshore structure having a floatable hull and a plurality of supporting legs, each supporting leg comprising a plurality of leg chords, the apparatus comprising:

a jacking assembly associated with each of the plurality of the legs chords for vertically moving said supporting legs;

a power means operationally connected to said jacking assembly for transmitting moving force to said jacking assembly;

a means coupled to said power means for controlling relative vertical displacement of the leg chords and preventing an out-of-range differential in the relative vertical displacement of the leg chords of each of the supporting legs; and a means for regulating inclination of the hull within a pre-determined limit during hull elevation and hull lowering procedures.

2. The apparatus of claim 1, further comprising a means for generating a bi-directional torque control of the power means to facilitate a constant supply of power to said jacking assembly, wherein said means for generating the bi-directional torque control comprises an inverter operationally connected to the power means and causing operation of the power means within a pre-determined constant power range.

3. The apparatus of claim 1, wherein said means for regulating inclination of the hull comprises a control means for regulating relative speed of movement of each of the supporting legs.

4. The apparatus of claim 3, wherein said means for regulating inclination of the hull further comprises at least one sensor mounted in the hull, said sensor providing a feedback to the control means indicative of position of the hull along two independent positional axes.

5. The apparatus of claim 3, further comprising a means for detecting speed of movement of each of said supporting legs.

6. The apparatus of claim 5, wherein said means for detecting speed of movement of a supporting leg comprises a meter unit mounted on each of the jacking assembly 30, said meter unit transmitting a signal to said control means.

7. The apparatus of claim 6, wherein said control means regulates movement of each chord with a pre-determined speed range in response to a signal indicative of the inclination of the hull.

8. An apparatus for regulating movement of a jacking system of a mobile offshore structure having a floatable hull and a plurality of supporting legs, each supporting leg having leg chords with racks, the apparatus comprising:

a plurality of jacking assemblies each jacking assembly being associated with a respective leg chord of a supporting leg for vertically moving said supporting leg;

a power means operationally connected to each of the said jacking assemblies for transmitting moving force to said jacking assembly;

an inverter operationally connected to each of said power means for generating a bi-directional torque control of the power means to facilitate a constant supply of power to each of said jacking assemblies;

a means for regulating inclination of the hull within a pre-determined limit during hull; elevation and hull lowering procedures comprising a sensor means for detecting relative position of the hull along forward-aft and starboard-port axes; and a control means for regulating speed of movement of each of the supporting legs relative to the hull within a pre-determined speed range.

9. The apparatus of claim 8, wherein said control means comprises a central control assembly for coordinating speed of vertical movement of the supporting legs so as to minimize leg bending during the vertical movement of the supporting legs.

10. The apparatus of claim 8, wherein said sensor means transmits a signal to the control means indicative of the hull position along dual axes.

11. The apparatus of claim 9, wherein said control means further comprises a plurality of leg position controller units, each leg position controller unit regulating position of individual leg chord of each of the supporting legs within a pre-determined ranges of distance and speed of vertical movement of each of the leg chords.

12. The apparatus of claim 11, further comprising a plurality of speed sensor units associated with each jacking assembly for detecting speed of movement of each leg chord and for transmitting data indicative of the speed of each leg chord movement to a respective leg position controller unit.

13. The apparatus of claim 11, wherein the central control unit is configured to receive data indicative of the speed of movement of each of the supporting legs and regulate operation of the leg position controller units depending on feedback received from the sensor means.

14. The apparatus of claim 9, wherein said central control assembly is configured to generate a signal indicative of relative vertical alignment between opposing racks of a supporting leg.

* * * * *